United States Patent [19]

Baumann

[11] Patent Number: 4,620,468

[45] Date of Patent: Nov. 4, 1986

[54] PUNCHING MACHINE

[75] Inventor: Benny Baumann, Baar, Switzerland

[73] Assignee: Ibico AG, Zurich, Switzerland

[21] Appl. No.: 703,367

[22] Filed: Feb. 20, 1985

[30] Foreign Application Priority Data

Feb. 21, 1984 [CH] Switzerland ..... 834/84

[51] Int. Cl.[4] ..... B26D 5/08

[52] U.S. Cl. ..... 83/524; 83/626; 83/632; 83/618

[58] Field of Search ..... 83/618, 167, 602, 615, 83/628, 632, 633, 624, 625, 626, 524, 526; 100/283

[56] References Cited

U.S. PATENT DOCUMENTS

| | | | |
|---|---|---|---|
| 791,146 | 5/1905 | Gether | 83/618 X |
| 2,260,223 | 10/1941 | Harper | 83/618 X |
| 2,832,410 | 4/1958 | Soss | 83/628 |

FOREIGN PATENT DOCUMENTS 518806 2/1972 Switzerland .

*Primary Examiner*—James M. Meister
*Assistant Examiner*—John L. Knoble
*Attorney, Agent, or Firm*—Blum Kaplan Friedman Silberman & Beran

[57] ABSTRACT

In order to drive a punching machine electrically, with the aid of a double-armed rocker (70) a translational motion for the compression beam (10) is generated on the one hand, and a rotary motion for an opposing drive on the other hand. On the one side, the double-armed rocker (70) is driven by a rotating clutch shaft (50) by way of a crank gear (60–66) and, on the other side, a chain link (73) serves to control the compression beam. The opposing drive is operated by means of a one-arm rocker (75) and, also, by means of a chain link (76). To ensure the execution of an exact cycle, an engaging and disengaging claw clutch (31, 36) is present. The cycle is maintained by a cam disk arrangement (51) on the one hand, and a coupling groove (37) on a coupling box (32) with a coupling bolt (38), on the other hand. The above provides the electric drive for a rectilinear punching machine for punching sheets of paper for mechanical binding systems.

6 Claims, 4 Drawing Figures

Figure 1:
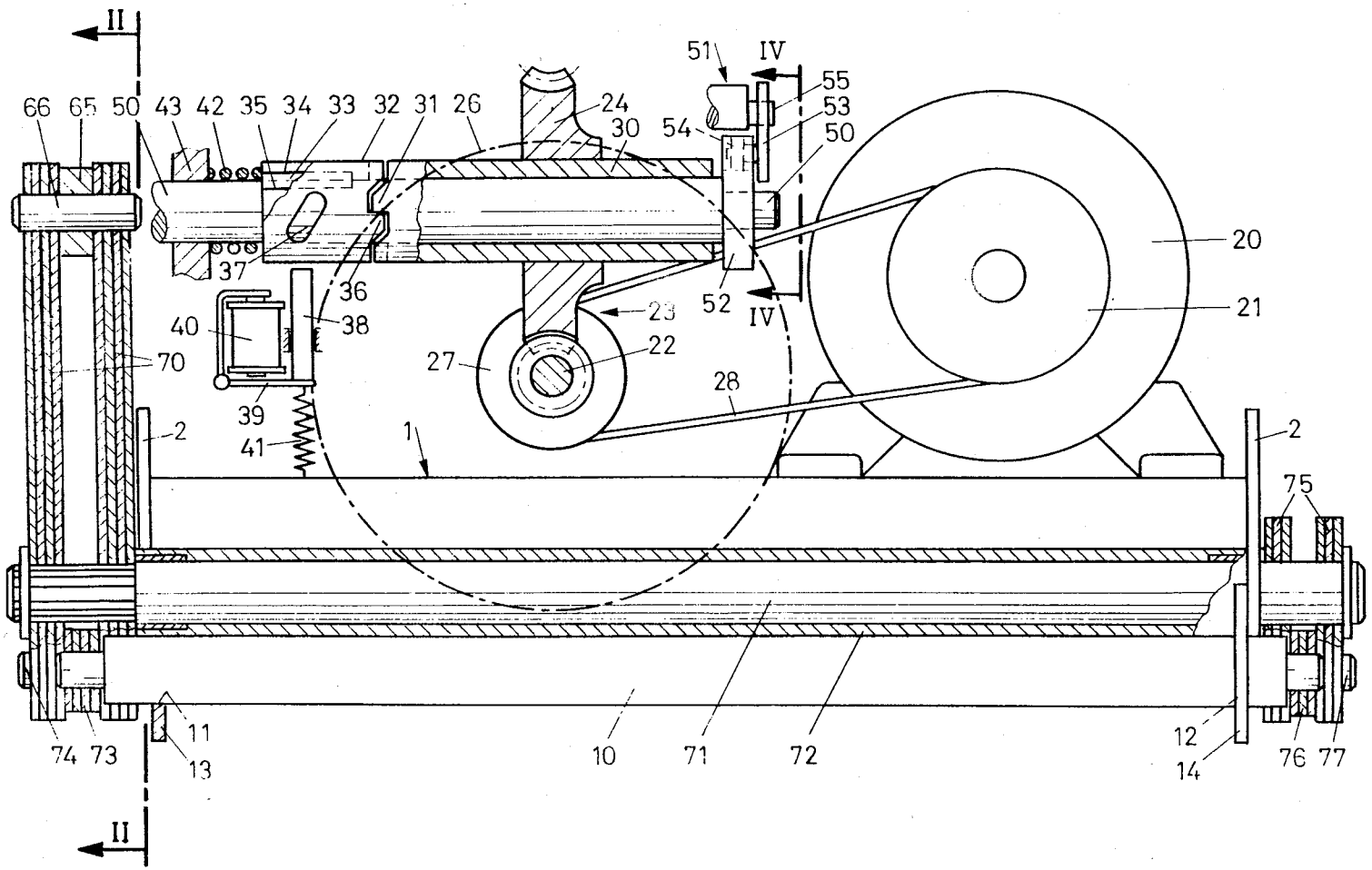

52
54
50
53
56
51
55
66
65
64
62
63
61
60
70
71
2
74
11
73
10
13
19
19A
18
18A
15
15A
15B
16
17B
17A
17

PUNCHING MACHINE

This invention concerns a punching machine for rectilinear hole punching, in particular for mechanical binding systems, according to the characterizing clause of the self-contained Patent claim 1.

Similar punching machines are well known. For example, one form of execution is described in CH-A No. 518 806. In this known machine, a number of punches are arranged in one row. Above these, there is a compression beam which moves vertically in supports, and which is equipped with fixed pins which act on the punches. A rotating shaft rotates in the supports and is equipped with a hand lever for the execution of rotary motions. A pressure bar drive in the form of a toothed wheel segment is attached to the shaft and reaches with its teeth in the rack-shaped recesses in the drive parts for the compression beam. Moreover, there are additional drive elements for opening the synthetic back-binding elements.

In similar hand-operated machines, the motion transfer and the exact cycle orientation of the motions are easy to resolve. In electrically driven punching machines, special arrangements have to be made in order to transform a rotary motion into an exact rectilinear translational motion with a sufficiently high power component for punching the side to be bound, while making sure that after the completion of a punching operation only one operating cycle is executed.

It is therefore the purpose of the invention to solve these problems. According to the invention, this is achieved by means of the properties of the characterizing portion of the self-contained Patent claim 1. In the derived patent claims, particularly advantageous forms of execution are described.

Figures 2, 3, 4:
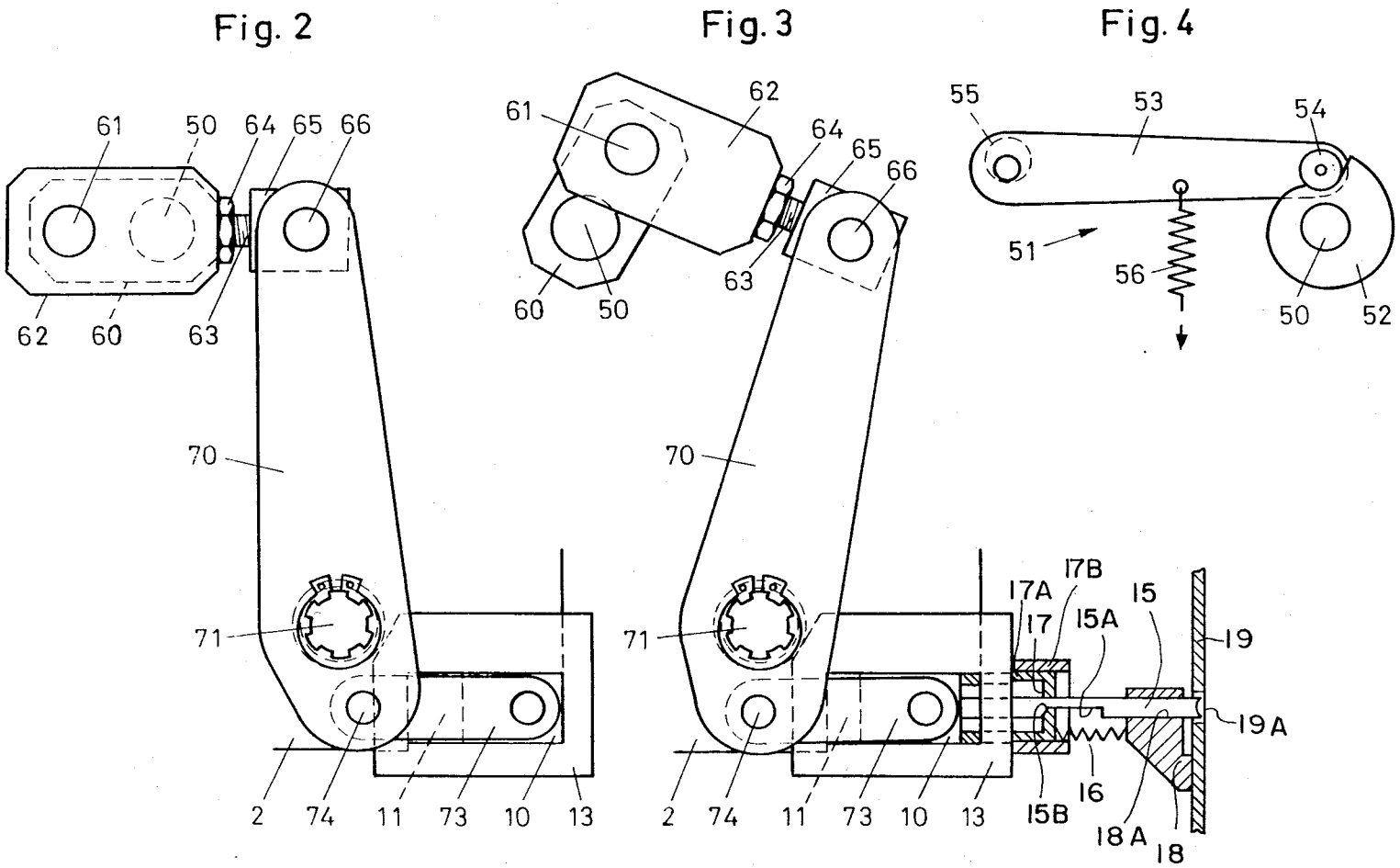

One example of execution of the invention is explained hereafter with the help of the drawing. The following are shown:

FIG. 1 a schematic top view of the punching machine,

FIG. 2 a view of the lateral part of the machine observed from the line II—II in FIG. 1, with the compression beam in the initial position, FIG. 3 a section from FIG. 2, in a later phase of the operating cycle, and FIG. 4 a view of a device for the zero position observed from the line IV—IV in FIG. 1.

FIGS. 1 and 2 show all the parts for driving the punches underneath the compression beam 10. These punches are not shown here because they, their guides and also the corresponding recesses in a swage plate for receiving the ends of the punches in the punching position, are known to every man of the trade and do not form part of this invention.

Reference is made to FIG. 3 wherein the punches, guides and recesses in the switch plate are shown. A punch knife 15 having a recessed portion 15A and shoulder portion 15B for retracting the punched knife rest against the end of compression beam 10. Punch knife 15 includes a recessed portion 15A and a shoulder 15B used to retract punch knife 15. Punch knife 15 is guided in a guiding slit 17 in retracting jacket 17A which itself is guided by guiding rail 17B. Punch 15 is guided at its other end by a punch knife guide 18, punch knife 15 riding in punch knife guide channel 18A. Punch knife guide 18 is coupled to swage plate 19 with an opening 19A through which punch knife 15 is adapted to move. A compression spring 16 is placed between punch knife guide 18 and retracting jacket 17A biasing the punch knife to the left (FIG. 3). Accordingly, when compression beam 10 moves to the right (FIG. 3), punch knife 15 is pushed through swage opening 19A. As compression beam 10 moves to the left (FIG. 3) biasing spring 16 pushes punch 15 to the left as well.

As FIG. 2 shows, the ends of the compression beam 10 are guided in the recesses 11, 12 of the compression beam guides 13, 14. These compression beam guides 13, 14 are attached, in an equally well-known manner, to the side walls 2 of a chassis 1 shown only in outline. Consequently, the compression beam 10 can execute an exactly limited rectilinear motion.

For driving the compression beam 10, an electric motor 20 with a pulley 21 is flange-mounted on the chassis 1. The motor shaft is perpendicularly mounted. Parallel to this motor shaft lies the worm shaft 22 of a worm gear 23 with a worm wheel 24, and at the end of the worm shaft 22 there is a flywheel 26 and a second pulley 27. A driving belt 28 runs from the pulley 21 at the motor 20 to the pulley 27 at the worm gear 23.

The worm wheel 24 is attached to a hollow shaft 30 with claws 31 for a claw clutch. A clutch shaft 50 rotates in the hollow shaft 30. A coupling box 32 is mounted on the clutch shaft 50 so it can disengage, and a flat key 33 with grooves 34, 35 in the clutch shaft 50 and coupling box 32 serves to transfer the motion when the claw clutch is engaged. For its part, the coupling box 32 is also equipped, at its one end, with claws 36 and approximately at its center there is a coupling groove 37, which runs at an angle to the surface line. A coupling bolt 38, operating in conjunction with this coupling groove 37, is attached to an anchor plate 39 of an electromagnet 40, and a spring 41 pulls the coupling bolt 38 out of the coupling groove 37 when the electromagnet 40 is not excited.

A coupling spring 42 is supported by a bearing block 43, also attached to chassis 1—as the case may be, to a side wall not shown here—and, when the coupling bolt 38 is pulled out of the coupling groove 37, it presses both claw parts 31, 36 together, as a result of which the driving power is transferred from the motor 20 to the clutch shaft 50.

It is a known fact that with an arrangement as the one described above, with a coupling groove 37 and a coupling bolt 38, one can never obtain a complete separation of the claw parts 31, 36 and that, as a result, the tips of these parts always touch. In order to assure a separation, a zero position device 51 is connected to the clutch shaft 50. A top view of this device is shown in FIG. 4. According to the latter, this device consists of a cam plate 52 which is rigidly connected to the clutch shaft 50. A cam follower lever 53 with a follower roller 54 is made to rotate by means of an eccentric 55, whereby the eccentric excursion falls in the direction of the path of the follower roller 54. A spring 56 is used in the traditional way to press the follower roller 54 against the cam plate 52.

The effect of the zero position device 51 is that, each time after a complete revolution, the clutch shaft 50 will receive another push in the direction of rotation, so that the coupling bolt 38 will push the coupling box 53 over a short distance, as per FIG. 1, to the left, so that a sufficient space will be created between the claw parts 31, 36.

For the explanation of the translational drive of the compression beam 10 we refer, in addition to FIG. 1, also to FIGS. 2 and 3. A crank plate 60 is rigidly attached to the clutch shaft 50. By means of a crank pin 61, a connecting plate 62 is linked to the free end of this crank plate 60, and the connecting plate 62 carries an articulated head 65, adjustable by means of a screw 63 and a nut 64. A double-armed rocker 70 is linked to the articulated head 65 by means of a connecting bolt 66.

The double-armed rocker 70 is rigidly connected to the main shaft 71 by means of a multi-groove profile. The main shaft 71 can rotate in a bearing tube 72. At the free end of the double-armed rocker 70, a chain link 73 can rotate by means of a chain stud 74. The chain link 73 connects the end of the compression beam 10 with the double-armed rocker 70.

The main shaft 71 transfers the rotary motion - imparted by the double-armed rocker 70 - to the other side of the machine. There, a one-arm rocker 75 is connected rigidly, in the same manner as the double-armed rocker 70- by means of a multi-groove profile- with the main shaft 71. As a result, it executes the same motion as the free end of the double-armed rocker 70.

In the same manner as for the double-armed rocker 70, a chain link 76 is connected to the one-arm rocker 75 by means of a chain stud 77, and transfers the driving power to the compression beam 10.

As is clearly shown in FIG. 1, the double-armed rocker 70, the one-arm rocker 75 and both chain links 73, 76, consist of several identically stamped plates. This makes it possible to maintain, at little cost, a practically rigid connection even at high loads.

I claim:

1. A punching machine for rectilinear hole punching, in particular for mechanical binding systems with a number of punches arranged in one row, a compression beam (10) acting on these punches and moving vertically in two lateral guides (13, 14), and with a rotating main shaft (71) for the simultaneous drive of both ends of the compression beam (10), characterized by the fact that the main shaft (71) is equipped, on the one hand, with a double-armed rocker (70) for transferring a motion from the driving part (15) to the main shaft (71) and the compression beam (10) and, on the other hand, with a one-arm rocker (75) for transferring the motion from the main shaft (71) to the compression beam (10), that for the transfer of the motion from the free ends of the rockers (70, 75) on the side of the compression beam to the compression beam (10), chain links (73, 76) are attached so they rotate to each of the rockers (70, 75) as well as to the compression beam (10), and that in the driving part (15) means are available (31–42, 51) in order to halt the motion of the rockers (70, 75) after each operating cycle.

2. Machine according to Patent claim 1, characterized by the fact that in the driving part (15) a motor (20) is coupled, by way of a reducing gear (23) and an engaging and disengaging claw clutch (31, 36),to a crank drive (60–66) which drives the double-armed rocker (70).

3. Machine according to Patent claim 2, characterized by the fact that the reducing gear is a worm gear (23) in which the shaft (30) of the worm wheel (24) is designed as a hollow shaft and equipped with claws (31) of the claw clutch, that in the hollow shaft mentioned (30), a clutch shaft (50) is installed which can be driven by way of a follower (33) by an engaging and disengaging coupling box (32) equipped with claws (36), that, in addition, the clutch shaft mentioned (50) is rigidly connected to a crank plate (60) belonging to the crank drive, and that, between the free end of the crank plate (60) and the double-armed rocker (70), there is a connecting plate (62) which is linked to the rocker (70) by means of an articulated head (65) and a connecting bolt (66).

4. Machine according to Patent claim 3, characterized by the fact that the coupling box (32) is equipped with a coupling groove (37) which makes the excursion possible, that, in addition, the coupling bolt (38) which is meant to contact the coupling groove (37) is equipped with a drive (39, 40) causing an axial motion, and that a coupling spring (42) is present to cause the coupling box (32) to enter into contact with the coupling part (33) at the hollow shaft (30).

5. Machine according to Patent claim 4, characterized by the fact that an adjusting cam disk (53) is rigidly attached to the clutch shaft (50), and that a cam follower lever (52) is mounted, so it can rotate, on an eccentrically executed pivot bearing (55).

6. Machine according to one of the Patent claims 1 to 5, characterized by the fact that both rockers (70, 75) each consist of several identical stamped metal components.

* * * * *